US005523728A

United States Patent [19]

McCorkle

[11] Patent Number: 5,523,728

[45] Date of Patent: Jun. 4, 1996

[54] MICROSTRIP DC-TO-GHZ FIELD STACKING BALUN

[75] Inventor: John W. McCorkle, Laurel, Md.

[73] Assignee: The United States of America as represented by the Secretary of the Army, Washington, D.C.

[21] Appl. No.: 292,442

[22] Filed: Aug. 17, 1994

[51] Int. Cl.[6] ..... H01P 5/12; H01P 5/10

[52] U.S. Cl. ..... 333/128; 333/26

[58] Field of Search ..... 333/128, 25, 26

[56] References Cited

U.S. PATENT DOCUMENTS 5,172,082 12/1992 Livingston et al. ..... 333/26

5,379,006 1/1995 McCorkle ..... 333/26

*Primary Examiner*—Paul Gensler

*Attorney, Agent, or Firm*—Freda L. Krosnick; Charles H. Harris

[57] ABSTRACT

A wideband (DC to GHz) PC-board Balun that is disclosed. The balun maintains low insertion loss and good balance for ultra wide band (UWB) applications such as impulse radar. The balun structure is formed by microstrip transmission lines on a dielectric substrate, having at least one inverting and one non-inverting transmission lines. The transmission lines are connected to form balanced transmission lines stacked about a ground plane. N transmission lines can be connected to form a $N^2$:1 impedance ratio balun. Ferrite cores placed about the transmission lines and resistor-capacitor circuits improve the low frequency operation of the balun.

17 Claims, 10 Drawing Sheets

(A)

(B)

(C)

MICROSTRIP DC-TO-GHZ FIELD STACKING BALUN

RIGHTS OF THE GOVERNMENT

The invention described herein may be manufactured, used, and licensed by or for the United States Government for Governmental purposes without payment to us of any royalty thereon.

BACKGROUND OF THE INVENTION

1. Field of the Invention

The present invention relates to a wideband (DC to GHz) PC-board Balun. This wideband balun is suitable for use in communication systems, radars, radio frequency transmitters, receivers, signal processors, and more specifically to ultra wide band width (UWB) applications such as impulse radar. The word "balun" was derived by joining the words "balanced" and "unbalanced" together, since it is the function of a balun to connect a balanced electrical network to an unbalanced electrical network. A balanced network is one where no ground currents flow and instead, there is a "plus" wire and a "minus" wire that counteract or balance each other.

2. Description of the Prior Art

A great variety of baluns are available commercially that cover a broad spectrum in terms of size, bandwidth, center frequency, and insertion loss. However, these commercial baluns do not have the wide bandwidth, balance, insertion loss, or power handling capability required for ultra wide bandwidth applications such as impulse radar. Impulse radar is presently being used in a variety of radar systems to detect aircraft, ground vehicles, people, mines, buried pipes, roadway faults, buried homicide victims, tunnels, leaking buried pipes, and similar items. Consequently, it is desirable to have a balun that maintains low insertion loss and good balance for UWB applications. Accordingly, it is an object of this invention to provide a balun that maintains low insertion loss and good balance for UWB applications.

A recent example of a wide bandwidth balun is shown in U.S. Pat. No. 5,172,082 to Livingston et al. This balun uses microstrip conductors on a printed circuit board to achieve a wide bandwidth. This design, however, requires external circuitry to achieve the phase inversion required by the balun. In addition, the balanced output does not have the field of the two lines aligned in a manner suitable for end launch applications such as feeding a horn antenna. This design also only provides a means for dividing the unbalanced signal into two transmission lines which only allows the balun to have a 4:1 impedance ratio. It does not provide a method for creating a greater impedance ratio as required in some applications. In addition, the operational bandwidth of the previous balun design does not extend down to DC (direct current).

SUMMARY OF THE INVENTION

Briefly, it is the object of this invention to provide a technique for building a PC-board balun that maintains low insertion loss and good balance for UWB (DC-to-Ghz) applications. The foregoing is achieved using a balun structure formed by microstrip lines on a dielectric substrate. The impedance ratio of the balanced transmission line to the unbalanced transmission line is $N^2$, where N is the number of microstrip transmission lines comprising the balun.

The unbalanced microstrip input signal is divided into N microstrip transmission lines by a splitter/combiner, where N is greater than or equal to two. The microstrip transmission lines are comprised of at least one inverting and one non-inverting transmission lines. The inverting and non-inverting transmission lines are connected in a manner to form a balanced signal line with a ground plane in between the balanced signals. These individual balun outputs can then be combined with other balanced signals, or with a single transmission line if N is odd, in order to form balanced signals with higher impedance ratios.

The inverting transmission line inverts the phase of the signal by tapering the conductors that make up the microstrip. The signal line is tapered outward to form a ground plane, while the ground plane is simultaneously tapered in to form a signal line. The tapering is done such that the transmission line maintains nearly constant characteristic impedance, while the position of the ground plane is inverted with regard to the field in the transmission line. All of the transmission lines, whether inverting or non-inverting must have substantially the same characteristic impedance and length in order to maintain equal signal time delays across the balun's entire frequency range.

At the balanced signal end of the balun, there are N vertically stacked parallel dielectric substrates. The non-inverted side of the balanced signal output is on the top of the top substrate, while the inverted side of the balanced signal output is on the bottom of the bottom substrate. The ground planes formed by the combination of each pair of signals causes the balanced signals to have their fields aligned and they can be end launched directly into a load such as a horn antenna or a twin lead transmission line.

N-1 resistor-capacitor (RC) circuits placed throughout the balun prevent short circuits at DC such that the balun maintains low VSWR to DC and maintains power transfer to the load at frequencies down to and including DC. The RC circuits can be placed at several locations throughout the circuit to perform this function.

Ferrite cores can be placed around the microstrip transmission lines in order to improve low frequency performance.

BRIEF DESCRIPTION OF THE DRAWINGS

A better understanding of the invention will be obtained when the following detailed description of the invention is considered in connection with the accompanying drawings in which.

DETAILED DESCRIPTION OF SPECIFIC EMBODIMENTS

Figure 1:
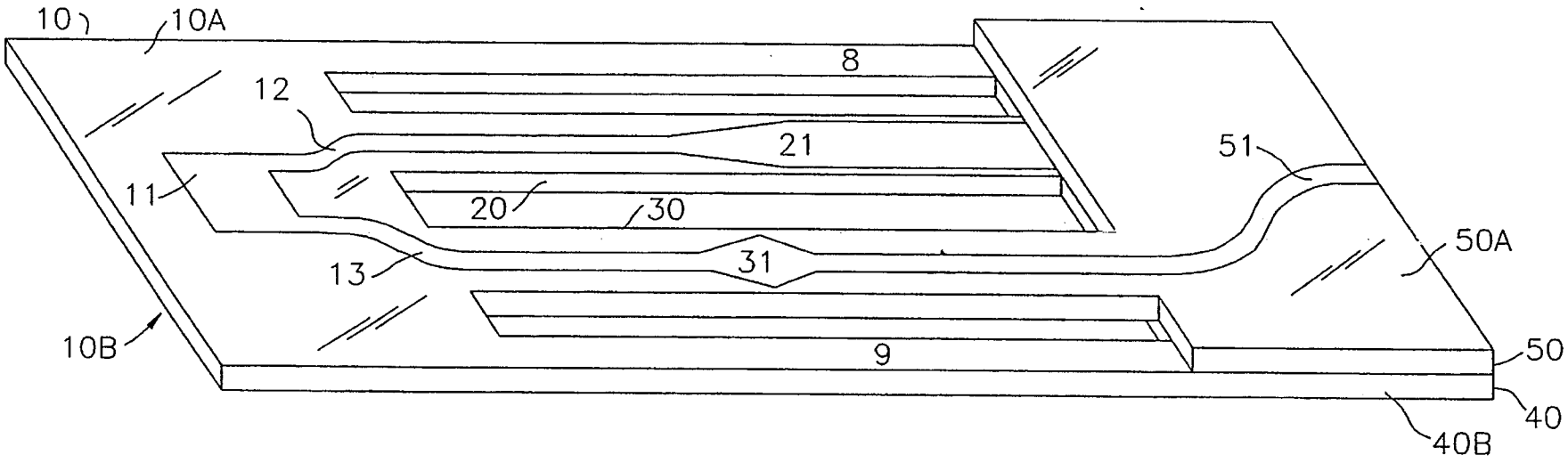
FIG. 1 depicts an elevated side angle view of embodiment A of the balun, a 4:1 impedance ratio balun consisting of two transmission lines.

The following detailed description of the DC-to-GHz PC-board Balun is of one specific embodiment of the balun, along with several variations of portions of the balun. The invention is described in three sections: the input and splitter/combiner section, the transmission line section, and the field stacking and balanced output section. Embodiment A of the balun is a 4:1 impedance ratio balun comprising only two transmission lines, an inverting and a non-inverting line. Like elements are identified with like reference numerals in each of the figures.

Referring to FIGS. 1–4, embodiment A of the DC-to-GHz PC-Board Balun comprises dielectric substrates, each having a planar parallel top and bottom surfaces for supporting metallization traces that form microstrip transmission lines. A microstrip transmission line is comprised of two conductive strips, a thin strip forming a signal line, and a dielectrically spaced ground plane.

Dielectric substrate 10 has surfaces 10*a* (top) and 10*b* (bottom) for supporting metallization strips. Dielectric substrate 20 has surfaces 20*a* (top) and 20*b* (bottom), dielectric substrate 30 has surfaces 30*a* (top) and 30*b* (bottom), dielectric substrate 40 has surfaces 40*a* (top) and 40*b* (bottom), and dielectric substrate 50 has surfaces 50*a* (top) and 50*b* (bottom). Dielectric substrates 40 and 50 form parallel planar surfaces that are stacked vertically. (FIG. 1) Metallization strips on surfaces 40*a* (see FIG. 3) and 50*b* (see FIG. 4) are in direct contact with each other and essentially form a single trace. Dielectric substrates 8 and 9 are optional and merely for structural support.

At the end of dielectric 20 nearest the launch 11, surfaces 20*a* and 20*b* are positioned at the same height as, and in direct contact with, surfaces 10*a* and 10*b*, respectively. At the second end of dielectric 20, surfaces 20*a* and 20*b* are positioned at the same height as and in direct contact with surfaces 40*a* and 40*b* respectively. At the first end of dielectric 30, surfaces 30*a* and 30*b* are also positioned at the same height as and direct contact with surfaces 10*a* and 10*b*, respectively. At the second end, however, surfaces 30*a* and 30*b* are positioned at the same height as and in direct contact with surfaces 50*a* and 50*b*, respectively.

The PC-board balun can be formed on two printed circuit boards, each consisting of a single dielectric layer capable of supporting metallization traces on both surfaces of the board. Dielectrics 8, 9, 10, 20, and 40 can all be constructed from the first printed circuit board with each dielectric lying flat in a single plane. Dielectric 50 can be constructed from a second smaller printed circuit board, which is vertically stacked on top of the larger first board over dielectric 40. Dielectric 30 can also be cut from the first board, but must transition from the plane created by the larger first board at the first end of dielectric 30 to the plane created by the second stacked board at the second end of dielectric 30. This transition can be made by bending the dielectric and using structural supports.

The unbalanced input and splitter/combiner section of the balun provides a connector for the unbalanced signal, which can be connected through an end launch or a surface launch. The splitter/combiner divides the signal into N transmission lines, where N is greater than or equal to two. The impedance of each of the transmission lines is N times that of the unbalanced signal line.

In embodiment A in FIGS. 1–4, the unbalanced signal line connection to the balun is made through an end launch connector formed by metallization trace 11 on surface 10*a*, and ground plane 14 on surface 10*b*. Traces 11, 12, and 13 form the splitter/combiner on surface 10*a*, with traces 12 and 13 having twice the characteristic impedance of trace 11.

Figure 5:
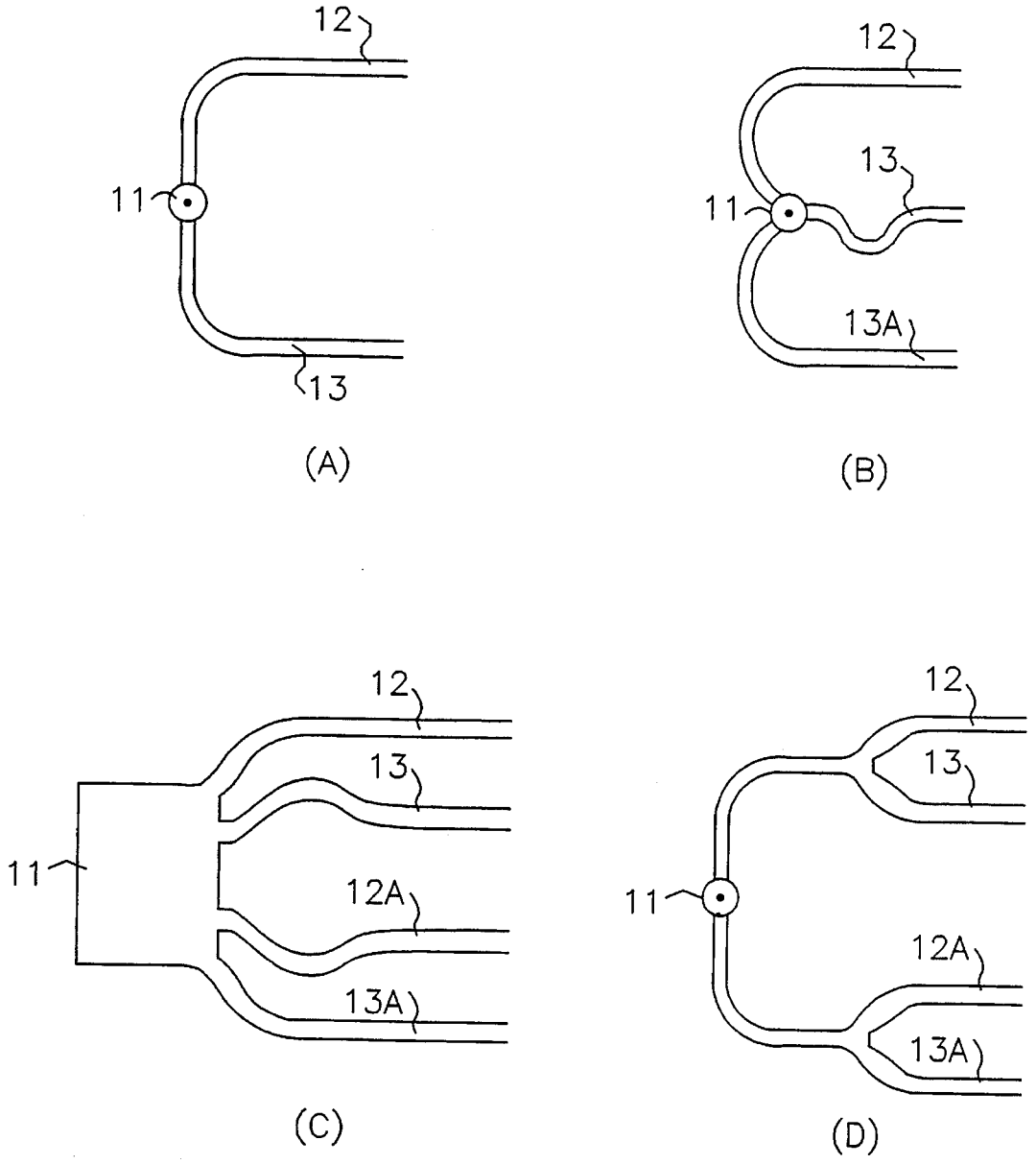
FIGS. 5(*a*)–5(*d*) depict four possible combinations of the unbalanced signal line connector and splitter/combiner, for baluns consisting of two to four transmission lines.

FIGS. 5(*a*)–5(*d*) show several possible variations for the input and splitter/combiner section of the balun. FIG. 5*a* depicts a surface launch connector 11 and the splitter/combiner dividing the signal into two transmission lines 12 and 13. FIG. 5*b* depicts a surface launch connector 11 and the splitter/combiner dividing the signal into three transmission lines 12, 13, and 13*a*. FIG. 5*c* depicts an end launch connector 11 and the splitter/combiner dividing the signal into four transmission lines 12, 13, 12*a*, and 13*a*. FIG. 5*d* depicts a surface launch connector 11 dividing the signal into two transmission lines, and those two transmission lines then additionally divided to form four transmission lines 12, 13, 12*a*, and 13*a*.

The transmission line section of the balun is comprised of inverting and non-inverting microstrip transmission lines. The balun must be comprised of at least one inverting and one non-inverting transmission line. All of the transmission lines must have substantially the same characteristic impedance and length. The signal time delay across each transmission line, subsequently, will be the same over all frequencies, as required in order for the balun to operate over a wide bandwidth.

The non-inverting microstrip transmission line is comprised of a thin signal line dielectrically separated from a ground plane. The signal line and ground plane may be slightly tapered to match the delay of the inverting transmission line. At the first end, the inverting microstrip transmission line is also comprised of a thin signal line that is dielectrically separated from a ground plane. The signal line, however, is tapered outward to form an inverted ground plane, and the ground plane is simultaneously tapered inward to form an inverted signal line such that the impedance remains constant, and the electromagnetic wave propagates with minimal loss. This inversion between the signal line and ground plane causes a phase inversion in the sense that the signal with respect to the ground plane at one end is inverted with respect to the ground plane at the other end. The non-inverting and inverting transmission lines are, therefore, carrying signals that are 180 degrees out of phase at their second ends.

Referring to embodiment A and FIGS. 1–4, the transmission line constructed on dielectric 20 is an inverting transmission line which has a substantially constant characteristic impedance equivalent to the impedance of strips 12 and 13. Conductive strip 21, which lies on surface 20*a* of the dielectric substrate, transitions from a signal line at the narrow end 21*a* through tapered section 21*b* to a ground plane at the wide end 21*c*. The narrow end 21*a* is connected to strip 12 and the wide end 21*c* is connected to ground plane 45, which lies on surfaces 40*a* and 50*b*.

Conductive strip 22, which lies on surface 20*b* of the dielectric substrate, transitions from a ground plane at the wide end 22*a* through a tapered section 22*b* to a signal line at the narrow end 22*c*. The wide end 22*a* is connected to ground plane 14 and the narrow end 22*c*, which has the same width and impedance as strip 21*a*, is connected to conductive strip 41 which lies on surface 40*b*. The tapered section 22*b* is a projection of the tapered section 21*b*, rotated 180 degrees about an axis that is perpendicular to the planar surface of transmission line 20. The tapered sections are inversely tapered relative to each other in order to maintain a constant characteristic impedance throughout the transmission line.

The transmission line constructed on dielectric 30 is a non-inverting transmission line which has a substantially constant characteristic impedance equivalent to the impedance of the inverting transmission line. Conductive strip 31, which lies on surface 30*a* of the dielectric substrate, transitions from a first narrow end 31*a* through a wider middle section 31*b* to a second narrow end 31*c*. The first narrow end 31*a* is connected to strip 13. The tapered section 31*b* is constructed such that the non-inverting transmission line maintains the same characteristic impedance and signal time delay as the inverting transmission line. The second narrow end, strip 31*c*, has the same width and characteristic impedance as 31*a* and is connected to microstrip 51 which lies on surface 50*a*.

Conductive strip 32, which lies on surface 30*b* of the dielectric substrate, transitions from a first wide end 32*a* through a tapered middle section 32*b* to a second wide end 32*c*. The first wide end 32*a* forms a ground plane and is connected to ground plane 14 through resistor-capacitor (RC) circuit 15. The second wide end 32*c* also forms a ground plane and is connected to ground plane 45 which lies on surfaces 40*a* and 50*b*. The tapered sections 31*b* and 32*b* are constructed such that the non-inverting transmission line maintains the same characteristic impedance and signal time delay as the inverting transmission line, although the effects of this tapering are minimal and not required for the balun to function effectively.

Figure 6:
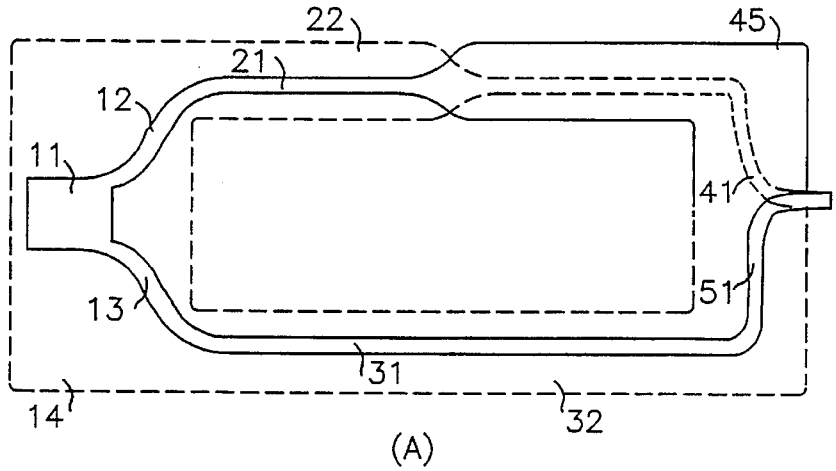
FIGS. 6(*a*)–6(*c*) depict three possible locations for the tapering of the conductors in the inverting transmission line for a two transmission line balun.
Figure 6:
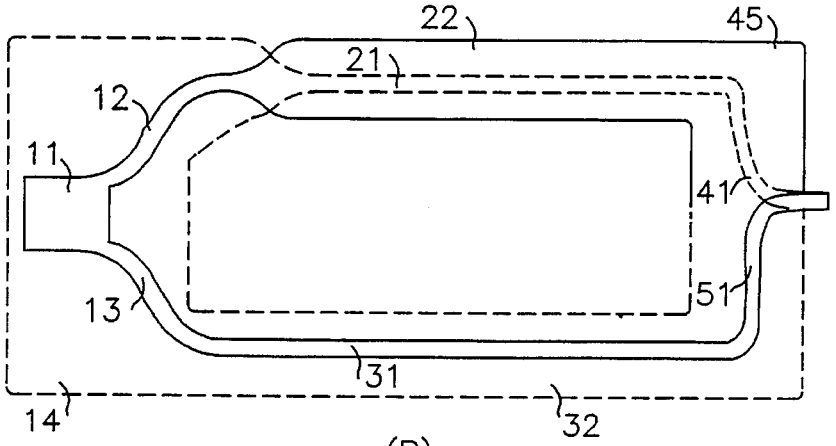
Figure 6:
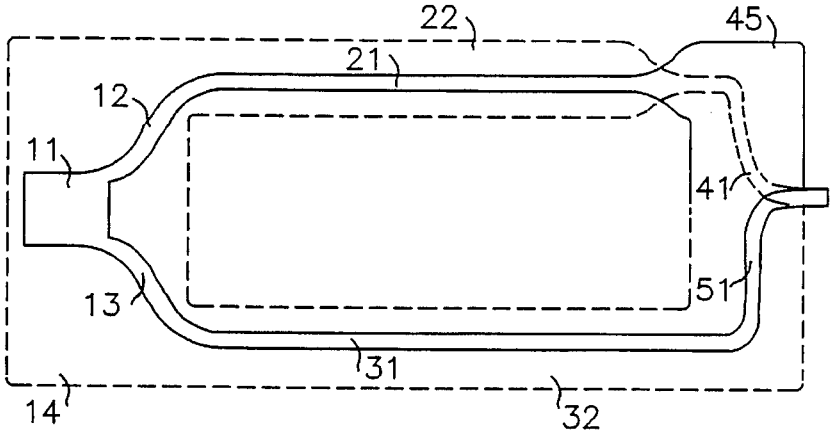

The tapering that creates the signal phase inversion in the inverting transmission line can occur at any point along the microstrip transmission line. FIGS. 6(*a*)–6(*c*) show three different locations for the tapering and inversion. In FIG. 6*a*, the tapering occurs halfway between the splitter/combiner end of the balun and the field stacking end of the balun. In FIG. 6*b*, the tapering occurs at the splitter/combiner end of the transmission line. In FIG. 6*c*, the tapering occurs at the field stacking end of the transmission line. As previously stated, the non-inverting line can also be tapered in order to better match the signal time delay between the transmission lines, but the tapering is not necessary.

If the unbalanced signal is split into N transmission lines, there must be N-1 resistor-capacitor (RC) circuits to prevent short circuits when DC is applied to the balun. In embodiment A shown in FIGS. 1–4, RC circuit 15 is placed between the non-inverting transmission line ground plane 32 and the input and splitter combiner ground plane 14. If the impedance of microstrip 11 is Z ohms, the impedance of microstrips 12 and 13 will be 2Z ohms. Noting that at DC, the resistor (R) in circuit 15 is in parallel with the balanced load, R can be chosen to be 4Z/3 so that an unbalanced source sees a matched load at DC. The resistor value is typically chosen to be 4Z/3 for the case where power is going into the input line and going to a load that is broadband matched from GHz to DC. When the load is not broadband matched, the RC network can be adjusted for either maximum power transfer or minimum VSWR. For the case where power is coming into 41 and 51, R is typically chosen to be an open circuit since, for this case, an open circuit provides both optimum power transfer and minimum VSWR. The capacitance of RC circuit 15 is typically formed by several capacitors. One of the capacitors is typically a high-Q low ESR (Equivalent Series Resistance) microwave capacitor to effectively be a short circuit at microwave frequencies. Another capacitor is usually a higher value capacitor that is chosen such that the total capacitance matches the inductance formed by the loop 14, 32, 45, 21, 12, 11, and the unbalanced source, so that the VSWR is 1:1 at all frequencies down to DC. The RC circuit could be placed at the junction of ground plane 45 and strip 32 rather than between strip 32 and ground plane 14, without affecting performance of the balun.

Figure 2:
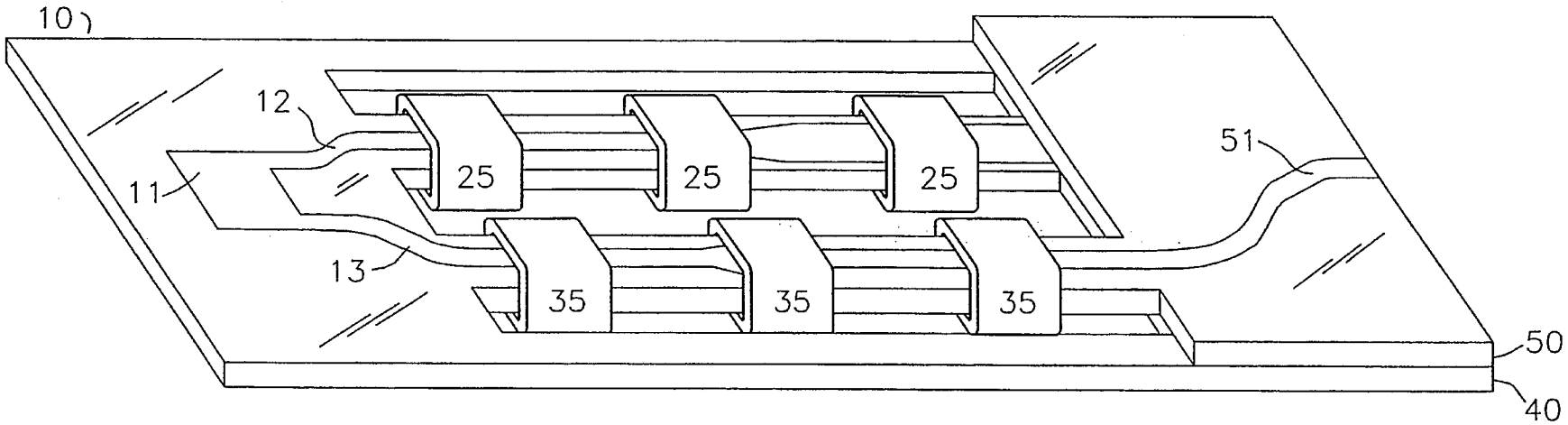
FIG. 2 depicts an elevated side angle view of balun A with ferrite cores around the transmission lines.
Figure 3:
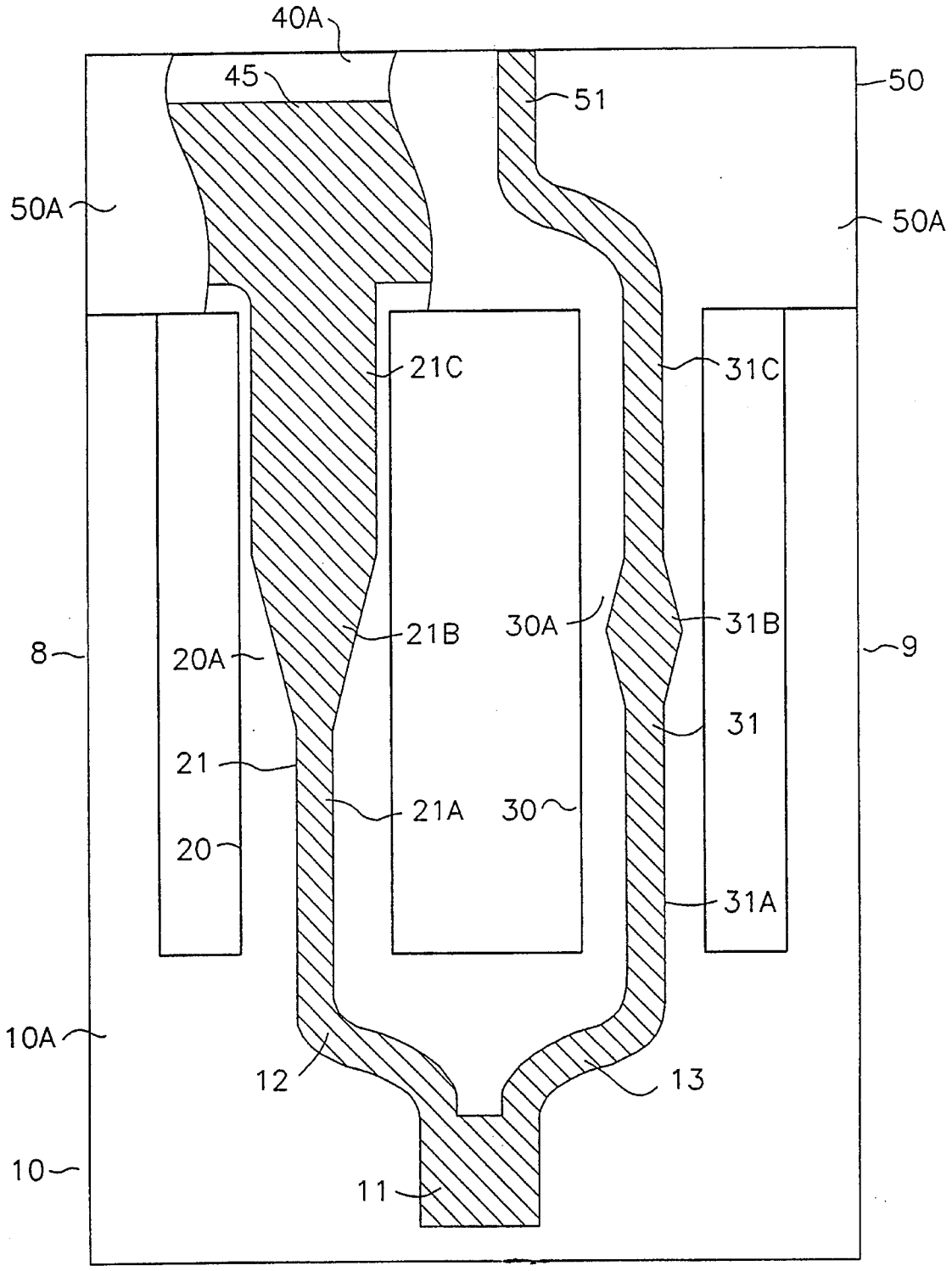
FIG. 3 depicts a top view of balun A, with a cutaway.
Figure 4:
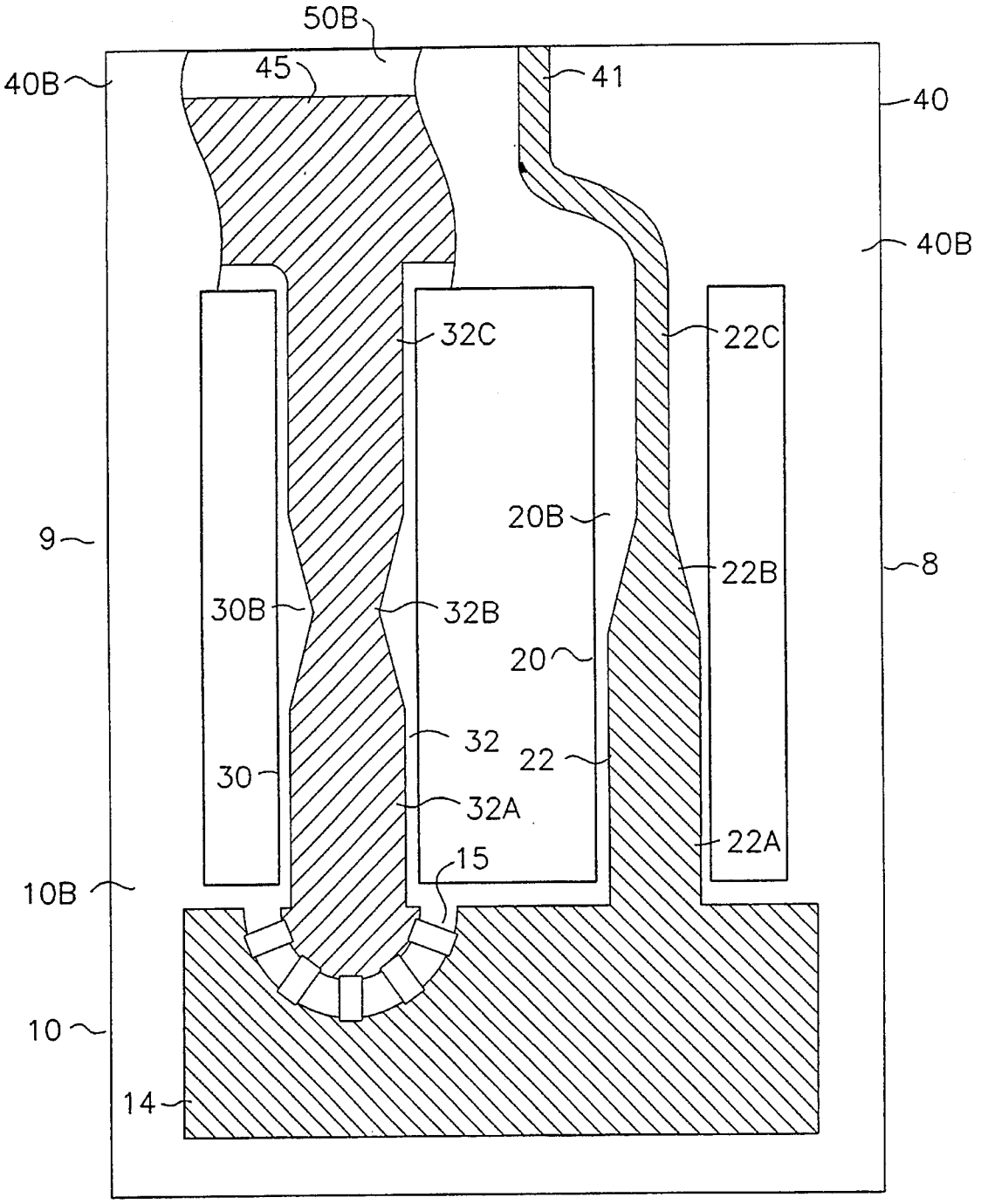
FIG. 4 depicts a bottom view of balun A, with a cutaway.

To extend the low frequency performance of the balun, ferrite cores can be placed around the inverting and non-inverting transmission lines. FIG. 2 shows embodiment A with three cores 25 placed around the inverting transmission line, and three cores 35 placed around the non-inverting transmission line.

The field stacking and balanced output section of the balun is comprised of N vertically stacked dielectric substrates. The dielectric substrate supporting a non-inverting transmission line is connected at its second end to one of the stacked dielectric substrates, and the substrate supporting an inverting transmission line is connected to the dielectric substrate immediately below. The ground plane of the non-inverting transmission line and the inverted ground plane of the inverting transmission line are connected by a ground plane located between the two dielectric substrates. The non-inverted signal line and the inverted signal line are aligned so that they are vertically stacked on either side of the ground plane, with the non-inverted signal line above the top of the two dielectric substrates and the inverted signal line below the bottom of the two substrates. The two signal lines, which extend beyond the ground plane, form a balanced line with two layers of dielectric between them and twice the impedance of the transmission lines. This balanced signal line can then be combined and stacked in a similar manner with other inverting or non-inverting transmission lines, or combined with another balanced line produced from another inverting and non-inverting transmission line pair.

When all of the transmission lines have been combined and stacked, the balun output is a balanced signal comprised of a non-inverted signal line on the top surface of the top dielectric substrate, and an inverted signal on the bottom surface of the bottom dielectric substrate. The impedance of the balanced signal output is $N^2$ times greater than the impedance of the unbalanced signal. The balanced signal can be end launched into a balanced load such as a horn antenna or a balanced transmission line such as a twisted pair or twin lead.

In embodiment A in FIGS. 1–4, dielectric substrate 50 is vertically stacked above dielectric substrate 40. Dielectric substrate 30, which supports the non-inverting transmission line, is connected at its second end to dielectric 50. Dielectric substrate 20, which supports the inverting transmission line, is connected at its second end to dielectric 40. Ground plane 45, which lies on surfaces 40*a* and 50*b*, is connected to the ground lines of both the non-inverting and inverting transmission lines, traces 32*c* and 21*c*, respectively. The non-inverted balanced signal line 51 is connected to trace 31*c* and lies on surface 50*a*. The inverted balanced signal line 41 is connected to trace 22*c* and lies on surface 40*b*. The signal lines 51 and 41 are aligned vertically, and extend beyond ground plane 45. These signal lines form a balanced signal line with an impedance four times that of the unbalanced signal line.

Figure 7:
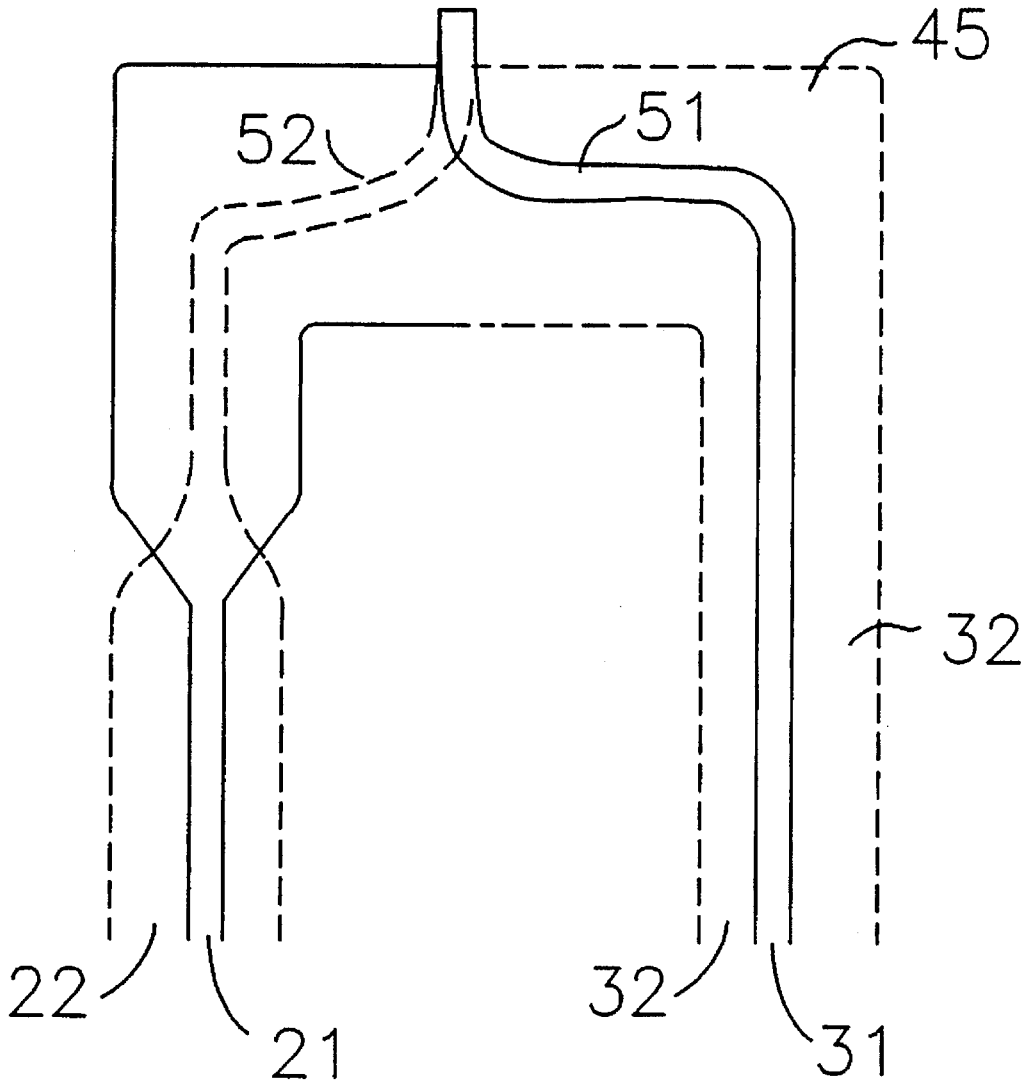
FIG. 7 depicts a close-up top view of the stacking portion of balun A.
Figure 8A:
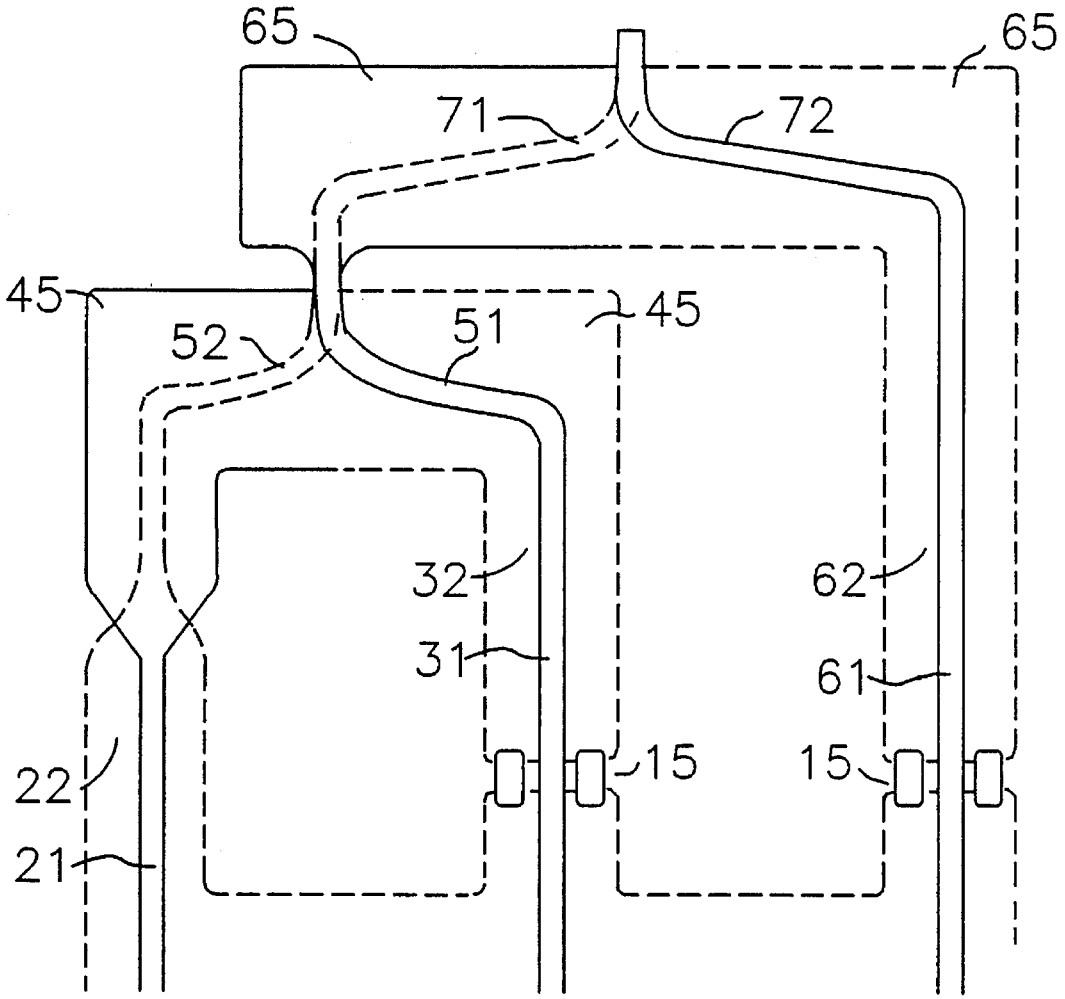
FIGS. 8(*a*) and 8(*b*) depict a close-up top view of the stacking portion of two variations of a three transmission line balun.
Figure 8B:
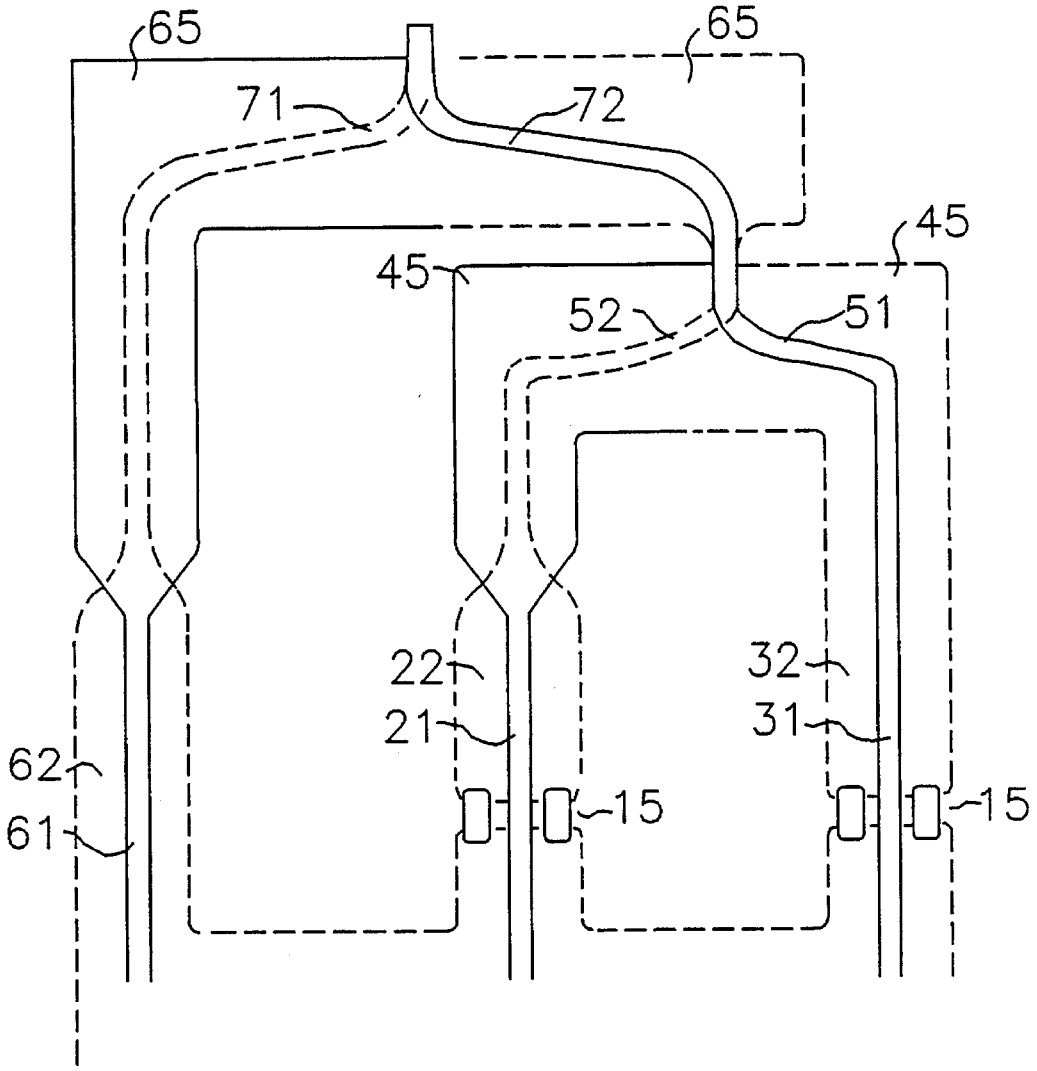
Figure 9:
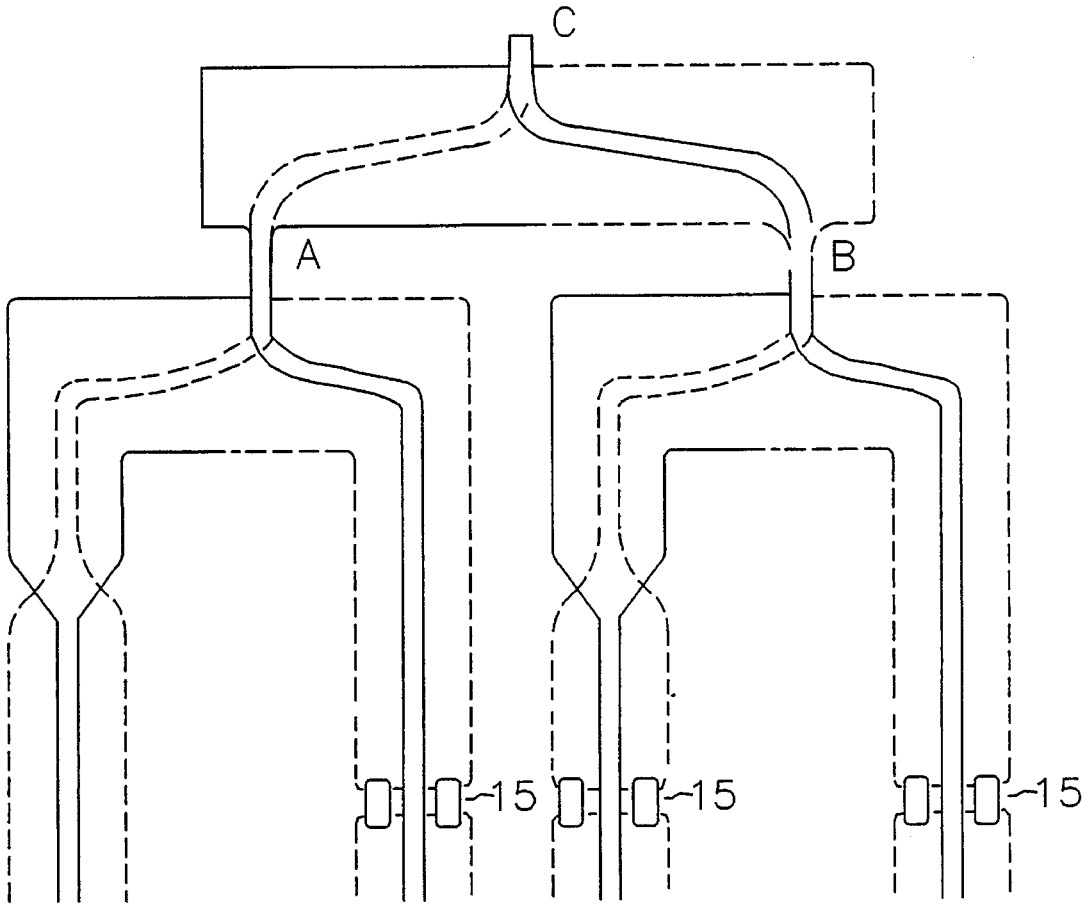
FIG. 9 depicts a close-up top view of the stacking portion of a four transmission line balun.

FIG. 7–9 show the electrical connections and the layout of the signal traces at the stacking end of the balun for several different configurations. The viewpoint of the drawings is from above the balun looking down. Signal lines that are drawn in solid lines are on the top side the dielectric. Signal lines that are drawn in dashed lines are on the bottom of a dielectric. The ground planes transition from a solid line to a dashed line because they are on the top side of the inverting transmission line, but on the bottom side of the non-inverting transmission line.

FIG. 7 depicts a two transmission line balun, as described in embodiment A. Signal traces 31 and 32 form the non-inverting transmission line, with trace 31 on the top side of the dielectric substrate. Traces 21 and 22 from the inverting transmission line, with trace 21 on the top side of the dielectric and at the same planar level as trace 32 at the stacking end of the balun. Ground plane 45 connects traces 21 and 32, and lies between the balanced output traces, 41 and 51. At the output, traces 41 and 51 extend beyond ground plane 45 and are separated by two layers of the dielectric substrate.

FIG. 8*a* depicts a first three transmission line balun, with a non-inverting transmission line comprised of traces 31 and 32, a inverting transmission line comprised of traces 21 and 22, and a second non-inverting transmission line comprised of traces 61 and 62. The first non-inverting transmission line and the inverting transmission line are connected the same as the two transmission line balun depicted in FIG. 7. The balanced outputs 41 and 51 are then combined with the second non-inverting transmission line to form a balanced signal with a higher impedance. The non-inverted signal line 51 is connected to trace 62 through ground plane 65. Traces 71 and 72 form the stacked balanced output, with three layers of dielectric between them. The distance the waveform must travel through each transmission line to the point where it is combined with another of the transmission lines must the same so that the signal phases will be properly aligned.

FIG. 8*b* depicts a three transmission line balun, similar to that in FIG. 8*a*, but consisting of only one non-inverting transmission line and two inverting transmission lines. The transmission lines are connected in a manner similar to the balun in FIG. 8*a*, except that the third transmission line is connected by ground plane 65 to the inverted signal line 41.

FIG. 9 shows how four transmission lines can be connected by first forming two balanced transmission lines at A and B, and then connecting the two balanced transmission lines to form a third balanced transmission line at C. The balanced lines at A and B are separated by two layers of the dielectric substrate, and the balanced line at C is separated by four layers of the dielectric substrate.

Obviously numerous modifications and variations of the present invention are possible in light of the above teachings. For example, the RC network could be changed to affect a different matching characteristic if desired or placed in a different location. In addition, although the balun operation as described above describes an unbalanced input being divided into a balanced signal, the balun also operates in the other direction converting a balanced input signal into an unbalanced signal. It is therefore to be understood that within the scope of the appended claims, the invention may be practiced otherwise than as specifically described herein.

What is claimed is:

1. A DC-to-GHz balun comprising:

a splitter/combiner having a first port for connection to an unbalanced line and further having N additional ports for providing split outputs or for receiving inputs to be combined;

N transmission lines connected to said N ports of said splitter/combiner, with no two of the N transmission lines connected to the same port;

said N transmission lines comprising at least one inverting transmission line of length A and substantially constant characteristic impedance;

said inverting transmission line having a first end connected to one of said N ports of said splitter/combiner, and said inverting transmission line having a second end comprising an inverted signal line and an inverted ground reference;

said N transmission lines further comprising at least one non-inverting transmission line of length A, said non-inverting transmission line having the same characteristic impedance and time delay as said inverting transmission line;

said non-inverting transmission line having a first end connected to one of said N ports of said splitter/combiner, and said non-inverting transmission line having a second end comprising a signal line and a ground reference;

a ground plane connected to said ground reference at said second end of said non-inverting transmission line, and said ground plane further connected to said inverted ground reference at said second end of said inverting transmission line;

a first balanced transmission line comprising a first balanced signal trace, said first balanced signal trace dielectrically separated from said ground plane and connected to said signal line at said second end of said non-inverting transmission line;

said first balanced transmission line further comprising a second balanced signal trace, said second balanced signal trace dielectrically separated from said ground plane and located on the opposite side of said ground plane from said first balanced signal trace, and said second balanced signal trace connected to said inverted signal line at said second end of said inverting transmission line;

a means for connecting said first balanced transmission line and the remaining N-2 of said transmission lines, if N is greater than two, such that the connections produce an output balanced transmission line; and said output balanced transmission line comprised of a third and fourth balanced signal trace, said third and fourth balanced signal traces separated by N layers of dielectric.

2. A DC-to-GHz balun according to claim 1, in which N=2 such that said balun is comprised of only one inverting and one non-inverting transmission lines.

3. A DC-to-GHz balun according to claim 1, in which N=3 such that said balun is comprised of one inverting and two non-inverting transmission lines.

4. A DC-to-GHz balun according to claim 1, in which N=3 such that said balun is comprised of two inverting and one non-inverting transmission lines.

5. A DC-to-GHz balun according to claim 1, in which N=4 such that said balun is comprised of two inverting and two non-inverting transmission lines.

6. A DC-to-GHz balun as in any of the preceding claims, further comprising a means for preventing short circuits when direct current is applied to said balun by dividing said balun with N-1 resistor-capacitor circuits.

7. A DC-to-GHz balun as in claim 1, further comprising ferrite cores, wherein at least one of said ferrite cores encircles at least one of said N transmission lines.

8. A 4:1 impedance ratio DC-to-GHz balun comprising:

a splitter/combiner having a first port for connection to an unbalanced line and further having a second and a third port for providing split outputs or for receiving inputs to be combined;

a phase inverting transmission line of length A and substantially constant characteristic impedance;

said inverting transmission line having a first end connected to said second port of said splitter/combiner, and said inverting transmission line having a second end comprising an inverted signal line and an inverted ground reference;

a non-inverting transmission line of length A and the same characteristic impedance and time delay as said inverting transmission line;

said non-inverting transmission line having a first end connected to said third port of said splitter/combiner, and said non-inverting transmission line having a second end comprising a signal line and a ground reference;

a ground plane connected to said ground reference at said second end of said non-inverting transmission line, and said ground plane further connected to said inverted ground reference at said second end of said inverting transmission line;

a balanced transmission line comprising a first balanced signal trace, said first balanced signal trace dielectrically separated from said ground plane and connected to said signal line at said second end of said non-inverting transmission line; and said balanced transmission line further comprising a second balanced signal trace, said second balanced signal trace dielectrically separated from said ground plane and located on the opposite side of said ground plane from said first balanced signal trace, and said second balanced signal trace connected to said inverted signal line at said second end of said inverting transmission line.

9. A DC-to-GHz balun as in claim 8, further comprising a means for preventing a short circuit when direct current is applied to said balun by dividing said balun with a resistor-capacitor circuit.

10. A DC-to-Ghz PC-board balun as in claim 8 or 9 wherein at least one ferrite core encircles at least one of said transmission lines.

11. A DC-to-GHz balun comprising:

a splitter/combiner having a first port for connection to an unbalanced line and further having N additional ports for providing split outputs or for receiving inputs to be combined, said splitter/combiner comprising a conductive signal divider trace and a first ground plane, said first ground plane dielectrically spaced from first said signal divider trace;

N transmission lines connected to said N ports of said splitter/combiner, with no two of the N transmission lines connected to the same port;

said N transmission lines comprising at least one inverting transmission line of length A and substantially constant characteristic impedance;

said inverting transmission line comprising first and second ends, said inverting transmission line further comprising a first tapered planar conductor that transitions along its length from a narrow width end at said first end of said inverting transmission line to a wide width end said second end of said inverting transmission line, said narrow width end of said first tapered planar conductor connected to said signal divider trace of said splitter/combiner;

said inverting transmission line further comprising a second tapered planar conductor dielectrically spaced from and parallel to said first tapered planar conductor, said second tapered planar conductor transitioning along its length from a wide width end at said first end of said inverting transmission line to a narrow width end at said second end of said inverting transmission line, said wide width end of said second tapered planar conductor connected to said first ground plane;

said first and second tapered planar conductors being rotated mirror images of each other, with the rotation being about an axis that is perpendicular to the plane of each conductor;

said N transmission lines further comprising at least one non-inverting transmission line of length A, said non-inverting transmission line having the same characteristic impedance and time delay as said inverting transmission line;

said non-inverting transmission line comprising a narrow signal conductor, said narrow signal conductor comprising a first and second end, said first end of said narrow signal conductor connected to said signal divider trace of said splitter/combiner;

said non-inverting transmission line further comprising a wide ground conductor, said wide ground conductor comprising a first and second end, said wide ground conductor dielectrically spaced from and parallel to said narrow signal conductor, and said first end of said wide ground conductor connected to said first ground plane;

a second ground plane connected to said wide width end of said first tapered planar conductor of said inverting transmission line, and said second ground plane also connected to said second end of said wide ground conductor of said non-inverting transmission line;

a first balanced transmission line comprising a first balanced signal trace, said first balanced signal trace dielectrically separated from said second ground plane and connected to said second end of said narrow signal conductor of said non-inverting transmission line;

said first balanced transmission line further comprising a second balanced signal trace, said second balanced signal trace dielectrically separated from said second ground plane and located on the opposite side of said second ground plane from said first balanced signal trace, and said second balanced signal trace connected to said narrow width end of said second tapered planar conductor of said inverting transmission line;

a means for connecting said first balanced transmission line and the remaining N-2 of said transmission lines, if N is greater than two, such that the connections produce an output balanced transmission line; and said output balanced transmission line comprised of a third and fourth balanced signal trace, said third and fourth balanced signal traces separated by N layers of dielectric.

12. A DC-to-GHz balun according to claim 11, in which N=2 such that said balun is comprised of only one inverting and one non-inverting transmission lines.

13. A DC-to-GHz balun according to claim 11, in which N=3 such that said balun is comprised of one inverting and two non-inverting transmission lines.

14. A DC-to-GHz balun according to claim 12, in which N=3 such that said balun is comprised of two inverting and one non-inverting transmission lines.

15. A DC-to-GHz balun according to claim 11, in which N=4 such that said balun is comprised of two inverting and two non-inverting transmission lines.

16. A DC-to-GHz balun as in claim 11, 12, 13, 14, or 15, further comprising a means for preventing short circuits when direct current is applied to said balun by dividing said balun with N-1 resistor-capacitor circuits.

17. A DC-to-GHz balun as in claim 11, further comprising ferrite cores, wherein at least one of said ferrite cores encircles at least one of said N transmission lines.

* * * * *